US006948191B2

(12) United States Patent
Avery et al.

(10) Patent No.: US 6,948,191 B2
(45) Date of Patent: Sep. 27, 2005

(54) PERSONAL PROTECTIVE SUIT WITH PARTIAL FLOW RESTRICTION

(75) Inventors: Martin J. Avery, Middlesex (GB); Raymond Odell, Hertfordshire (GB); Jason A. Graves, Berkshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 500 days.

(21) Appl. No.: 10/263,892

(22) Filed: Oct. 3, 2002

(65) Prior Publication Data

US 2003/0192103 A1 Oct. 16, 2003

Related U.S. Application Data

(63) Continuation-in-part of application No. 10/121,306, filed on Apr. 12, 2002, now abandoned.

(51) Int. Cl.[7] ..... A41D 13/00
(52) U.S. Cl. ..... 2/456; 2/906
(58) Field of Search ..... 2/69, 22, 2.11, 2/901, 84, 202, 2.17, 94, 93, 69.5, 206, 79, 268, 456, 457, 458, 2.16, 114, 2.14; 128/201.29, 201.28, 203.28, 205.13, 205.17, 205.29, 204.18

(56) References Cited

U.S. PATENT DOCUMENTS

| | | | |
|---|---|---|---|
| 3,064,488 | A | 11/1962 | Lee et al. |
| 3,446,420 | A | 5/1969 | Rinecker |
| 3,525,334 | A | 8/1970 | Braman et al. |
| 3,768,467 | A | 10/1973 | Jennings |
| 3,777,750 | A | 12/1973 | Savornin |
| 4,172,454 | A | 10/1979 | Warncke et al. |
| 4,272,851 | A | 6/1981 | Goldstein |
| 4,458,680 | A | 7/1984 | Childers et al. |

(Continued)

FOREIGN PATENT DOCUMENTS

| | | | |
|---|---|---|---|
| DE | 156463 | | 9/1982 |
| DE | 93 04 883 | U1 | 6/1993 |
| EP | 0 233 995 | A1 | 9/1987 |
| EP | 0 211 914 | B1 | 10/1988 |
| EP | 0 468 188 | B1 | 1/1992 |
| EP | 0 474 372 | A2 | 3/1992 |
| EP | 0 353 417 | B1 | 11/1992 |
| EP | 0 488 880 | B1 | 10/1995 |
| FR | 2 565 662 | | 12/1985 |
| GB | 2 032 255 | A | 5/1980 |
| GB | 2061696 | A | 5/1981 |
| GB | 2173705 | A | 10/1986 |
| GB | 2 220 573 | A | 1/1990 |

(Continued)

OTHER PUBLICATIONS

"The Next Step . . . " 3M Innovation Brochure (2001).
"SE–Shield Protective Suit for SE400", downloaded from the internet archive site at http://web.archive.org/web/*/http://www.sea.com.au/docs/data/dsseshield.htm . According to the internet archive, this page first appeared on Jan. 11, 2002.

*Primary Examiner*—Tejash Patel
(74) *Attorney, Agent, or Firm*—Karl G. Hanson; David R. Cleveland

(57) ABSTRACT

A personal protective suit for a wearer includes a hood portion located generally above the wearer's neck and at least partially enveloping the wearer's nose and mouth, a body portion located generally below the wearer's neck and at least partially enveloping the wearer's torso, an air delivery system that can deliver air to the hood portion, a vent that can permit gasses to escape from the body portion, and a partial flow restriction between the hood portion and body portion of the suit. The partial flow restriction permits gasses to pass from the hood portion to the body portion while reducing carbon dioxide levels in front of the wearer's mouth. The suit can be fabricated without requiring a face piece.

10 Claims, 3 Drawing Sheets

U.S. PATENT DOCUMENTS

| | | | | |
|---|---|---|---|---|
| 4,602,658 | A | | 7/1986 | Luther et al. |
| 4,614,186 | A | | 9/1986 | John |
| 4,651,727 | A | | 3/1987 | Howorth |
| 4,741,333 | A | | 5/1988 | Suzuki et al. |
| 4,771,771 | A | | 9/1988 | Walther |
| 4,807,614 | A | | 2/1989 | van der Smissen et al. |
| 4,811,728 | A | | 3/1989 | Von Kopp |
| 4,818,122 | A | | 4/1989 | Arbuthnot |
| 4,864,654 | A | | 9/1989 | Schriver et al. |
| 4,881,539 | A | | 11/1989 | Pasternack |
| 4,899,740 | A | | 2/1990 | Napolitano |
| 4,903,694 | A | | 2/1990 | Hager |
| H863 | H | | 1/1991 | Kwiedorowicz et al. |
| 5,003,974 | A | | 4/1991 | Mou |
| 5,125,402 | A | | 6/1992 | Greenough |
| 5,140,980 | A | | 8/1992 | Haughey et al. |
| 5,186,165 | A | | 2/1993 | Swann |
| 5,309,901 | A | | 5/1994 | Beaussant |
| H1316 | H | | 6/1994 | McGuinness |
| 5,339,806 | A | | 8/1994 | Beaussant et al. |
| H1360 | H | | 10/1994 | Grove et al. |
| 5,431,156 | A | | 7/1995 | Sundstrom |
| 5,515,846 | A | | 5/1996 | Drews |
| 5,526,804 | A | | 6/1996 | Ottestad |
| 5,588,153 | A | * | 12/1996 | Ignon et al. ..... 2/457 |
| 5,653,225 | A | | 8/1997 | Schegerin |
| 5,655,374 | A | * | 8/1997 | Santilli et al. ..... 62/3.5 |
| 5,690,095 | A | | 11/1997 | Glynn et al. |
| 5,832,919 | A | | 11/1998 | Kano et al. |
| 5,921,388 | A | | 7/1999 | Petrilli et al. |
| 5,957,131 | A | | 9/1999 | Hutchinson et al. |
| 5,991,921 | A | * | 11/1999 | Saito ..... 2/69 |
| 6,014,971 | A | | 1/2000 | Danisch et al. |
| 6,076,571 | A | | 6/2000 | Burns et al. |
| 6,158,429 | A | | 12/2000 | Gardner et al. |
| 6,340,024 | B1 | | 1/2002 | Brookman et al. |
| 6,575,165 | B1 | | 6/2003 | Cook et al. |
| 2001/0052144 | A1 | | 12/2001 | Paris et al. |

FOREIGN PATENT DOCUMENTS

| | | |
|---|---|---|
| GB | 2 247 175 | 2/1992 |
| GB | 2 247 396 A | 3/1992 |
| WO | WO 86 04508 | 8/1986 |
| WO | WO 92/04835 | 4/1992 |
| WO | WO 92/09332 | 6/1992 |
| WO | WO 92/18201 | 10/1992 |
| WO | WO 01 41873 | 6/2001 |
| WO | WO 01/74449 A1 | 10/2001 |
| WO | WO 02/11815 | 2/2002 |

* cited by examiner

PERSONAL PROTECTIVE SUIT WITH PARTIAL FLOW RESTRICTION

CROSS-REFERENCE TO RELATED APPLICATION

This application is a continuation-in-part of application Ser. No. 10/121,306 filed Apr. 12, 2002, now abandoned entitled PERSONAL CONTAINMENT SYSTEM WITH ISOLATED BLOWER, the entire disclosure of which is incorporated herein by reference.

This invention relates to protective suits adapted to a wearer or user from a contaminated environment. This invention also relates to protective suits having ah air delivery system.

BACKGROUND

Personal containment systems can protect a user from a variety of harmful chemical or biological agents. Many examples of personal containment systems that can surround a user are known, such as protective suits, protective tents, casualty bags for injured persons, and the like. These systems preferably isolate the user's entire body from contaminants. Often, the contaminants include respiratory hazards, and the systems must employ air delivery systems so that the user is able to breathe when isolated from the environment. Respirators are often used in conjunction with personal protection systems to provide the user with purified air. A variety of respirators are known and described below.

Certain personal containment systems employ a non-powered purifying respirator. Air is drawn into the system through a filter by the user's breathing action. When the user draws a breath, negative pressure is created in the system and air is drawn in through the filter. When the user expels a breath, spent air leaves the system through a valve.

A powered air-purifying respirator (PAPR) can be employed to supply a continuous stream of filtered air under positive pressure to a personal containment system. A typical PAPR includes a filter attached to a blower which delivers filtered air to the system. Such air delivery can involve a conduit that ducts air to a hood or a spigot on a protective garment. PAPRs are generally powered by a battery. When used with a protective garment, the PAPR blower typically is mounted on a belt wrapped around a user's waist or on a harness strapped to the user's torso, and worn externally. PAPRs are generally employed in industrial applications where the environmental hazards are well defined and quantified.

A self-contained breathing apparatus (SCBA) is another variety of respirator employed as a part of a personal containment system. A SCBA typically supplies air or oxygen from a portable source to a regulator or other breathing device worn by the user. A SCBA worn inside a sealed protective suit provides the user with a fully contained protective environment. SCBA systems employed in this manner can be used when the nature of the hazard is not known, or in environments that might be void of oxygen.

SUMMARY OF THE INVENTION

Recently published PCT Application No. WO 01/74449 A1 describes a protective suit having a harness-borne pump unit positioned inside the suit. The pump unit supplies filtered breathing air through a hose connected to a face piece inside the suit. Ventilation is provided in the remainder of the suit via exhaustion of air from the face piece into the suit through a non-return valve, or via supply of a stream of ventilation air from the pump to hoses directed towards the extremities of the arms and legs of the suit. Air is exhausted from the suit by a non-return valve located at the rear of the suit's head portion.

Suit comfort can be improved by supplying breathing air to an outlet in the suit's hood or head portion and by exhausting air from the suit through a non-return valve located below the wearer's neck in the body portion of the suit. This provides a comfort-enhancing airflow stream through the suit. It would be desirable to fabricate a suit that embodies such an airflow stream but which does not include a face piece. Typically it takes more time for a wearer to don a protective suit that includes a face piece. In some circumstances (e.g., first responder applications), such time is of the essence. In addition, face piece assemblies also relatively expensive to manufacture and can add substantially to the overall cost of a protective suit.

It can be difficult to meet regulatory requirements in suits made without a face piece but embodying the above-described comfort-enhancing airstream. For example, current European protective hood regulations (EN 12941:1998) require that the carbon dioxide ($CO_2$) concentration measured just in front of the wearer's lips not exceed 1% when tested in accordance with European Standard EN12941:1998. We have found that air that freely passes from the head portion of the suit to a non-return valve located below the wearer's neck tends not to carry with it a sufficient quantity of $CO_2$ exhaled by the wearer. Instead the exhaled $CO_2$ tends to accumulate in front of the wearer's lips, thereby elevating the $CO_2$ level at the measurement location mandated by such European regulations. We found that by adding a partial flow restriction between the hood portion and the body portion, we obtained improved air management within the suit and a reduction in measured $CO_2$ levels.

The invention provides, in one aspect, a personal protective suit for a wearer, comprising:

- a generally fluid-tight barrier comprising a hood portion located generally above the wearer's neck and at least partially enveloping the wearer's nose and mouth, and a body portion located generally below the wearer's neck and at least partially enveloping the wearer's torso;
- an air delivery system that can deliver air to the hood portion;
- a vent that can permit gasses to escape from the body portion;
- a partial flow restriction between the hood portion and body portion that can permit gasses to pass from the hood portion to the body portion while reducing carbon dioxide levels in front of the wearer's mouth.

The invention permits fabrication of a protective suit that can provide a comfort-enhancing airstream and reduced measured $CO_2$ levels without employing a face piece.

DETAILED DESCRIPTION

The personal protective suits of the invention can be any of a variety of protection systems that preferably surround or otherwise encase or encapsulate the wearer and may be suitable for protecting living things from a contaminated or hazardous environment. For example, the suit can be a fully enveloping protective garment such as a chemical suit or a hooded casualty bag. The suit can also be a partially protective garment such as a smoke hood and tunic. Still other examples, both known and unknown, are intended to fall within the scope of this invention. The inner environment of the personal protective suit is intended to be habitable and contaminant-free when worn in a contaminated or hazardous outer environment.

Figure 1:
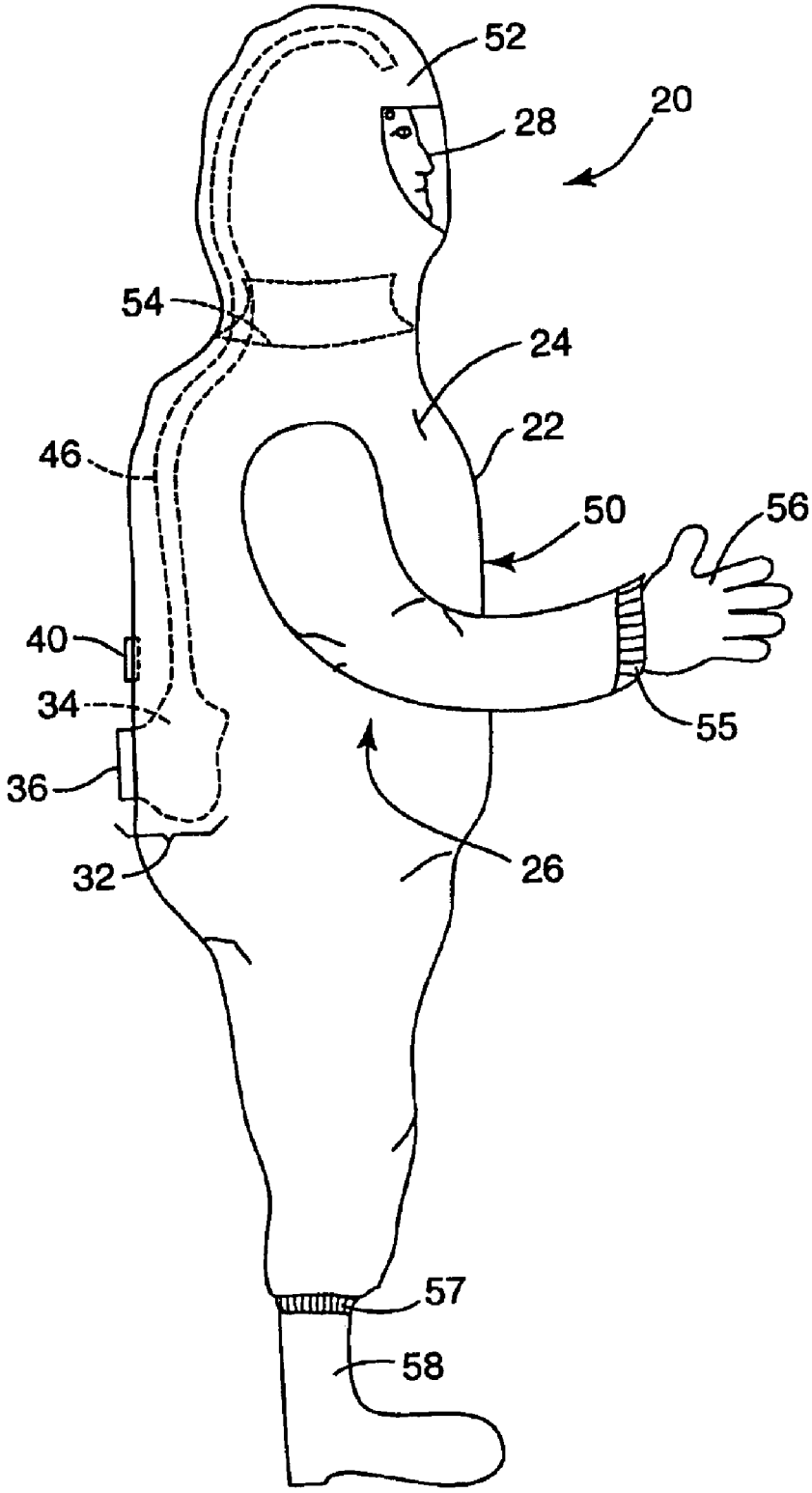
FIG. 1 shows a schematic side view of a personal protective suit constructed in accordance with the present invention.
Figure 2:
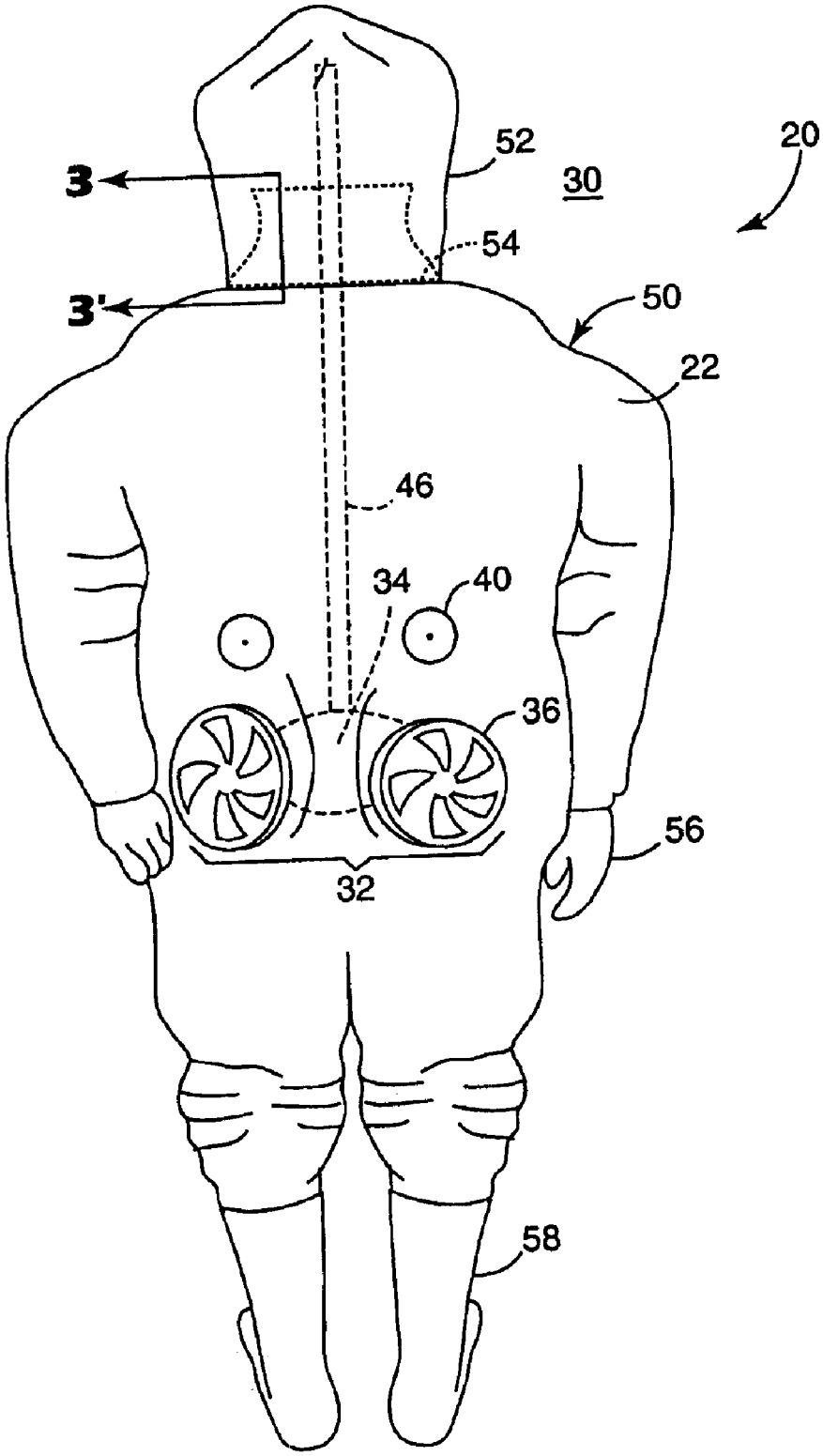
FIG. 2 shows a rear view of a personal protective suit of the invention.

FIG. 1 shows a schematic side view and FIG. 2 shows a rear view of an example, or embodiment, of personal protective suit 20 constructed in accordance with the present disclosure. Suit 20 includes a body portion 50 that generally envelops the torso 24 of wearer 26 and a preferably integrally formed hood 52 that generally envelops the head 28 of wearer 26. Hood 52 is drawn at the neck with a porous knitted elastic neck seal 54 (shown in phantom) that provides a partial flow restriction between hood portion 52 and body portion 50, thereby yielding improved air management and better control of localized carbon dioxide levels within suit 20. Suit 20 typically includes gloves 56, boots 58, elastic arm cuffs 55 that provide an improved seal near gloves 56 and elastic leg cuffs 57 that provide an improved seal near boots 58.

Suit 20 includes an air delivery system 32, shown in this embodiment as a PAPR whose blower 34 (shown in phantom) and filters 36 are located near the lower back of the wearer 26. Air delivery system 32 can also be a SCBA system, a remotely-supplied air line, or other air delivery systems that will be familiar to those skilled in the art. System 32 can be secured in place in a number of ways. For example, PAPR blower 34 can be placed in a pouch or pocket within suit 20, or can be worn on a belt around the waist of wearer 26, or the like. A conduit 46 (shown in phantom) is attached to system 32 and extends up the back of suit 20, through porous neck seal 54 and into hood 52.

Suit 20 also includes vent 40 located in body portion 50, below the neck of wearer 26. In one embodiment, vent 40 is a one-way valve that opens automatically after the pressure within inner environment 28 has reached a certain threshold. More than one vent 40 can be used.

Air from the outer environment is drawn into the filters 36 interfacing with the outer environment. Filtered air is delivered from the filters 36 to the hood portion 52 of suit 20 via blower 34 and conduit 46. Air is expelled into the outer environment through vent 40.

Figure 3:
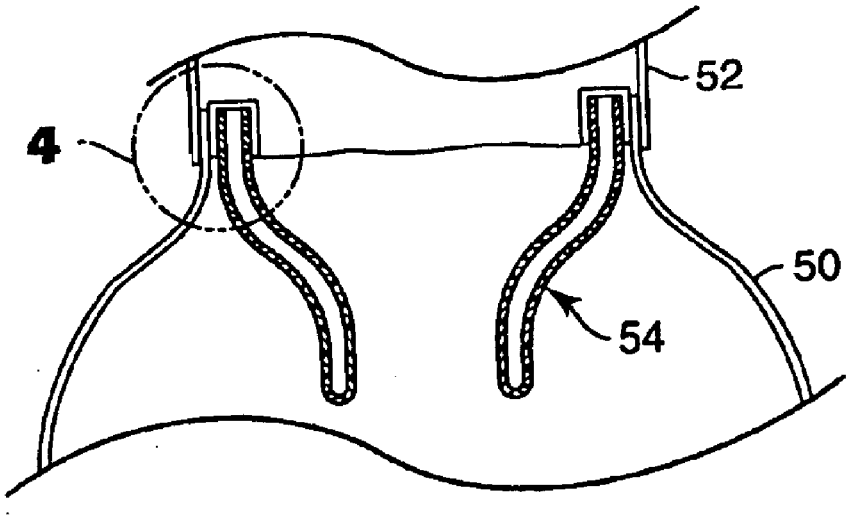
FIG. 3 shows a cross-sectional view of a portion of FIG. 2, showing a porous neck collar for use in a protective suit of the invention.

FIG. 3 shows a cross-sectional view of porous knit neck seal 54 taken along line 3–3' in FIG. 2. As shown, porous knit neck seal 54 is in the unworn state before a wearer's head has been inserted through seal 54. Seal 54 thus dangles downward inside suit 20 when suit 20 is held in an upright position. Seal 54 preferably is sufficiently flexible and elastic so that upon insertion of a wearer's head into the hood portion 52 of suit 20, seal 54 will easily expand to slide over the wearer's head and then contract sufficiently to form a snug but not uncomfortable seal around the wearer's neck, e.g., as when donning a turtleneck sweater or a diver's dry suit. Porous seal 54 can be made from a variety of materials such as woven or knitted cotton or synthetic fibers, or from a nonwoven fabric. Normal fabric pores or other suitable openings in porous seal 54 permit passage of gasses from hood portion 52 to body portion 50 while providing a partial flow restriction between hood portion 52 and body portion 50. Porous seal 54 can measurably reduce $CO_2$ levels measured near the mouth of a wearer. For example, when porous seal 54 was omitted from a suit 20 of the invention like that shown in FIG. 1 and FIG. 2, the measured $CO_2$ level was in excess of 2.5% when tested in accordance with European Standard EN 12941:1998. When porous seal 54 was added to the suit, the measured $CO_2$ level dropped to 0.35%. Preferably the measured $CO_2$ level is less than about 1%, and more preferably less than about 0.5%.

Figure 4:
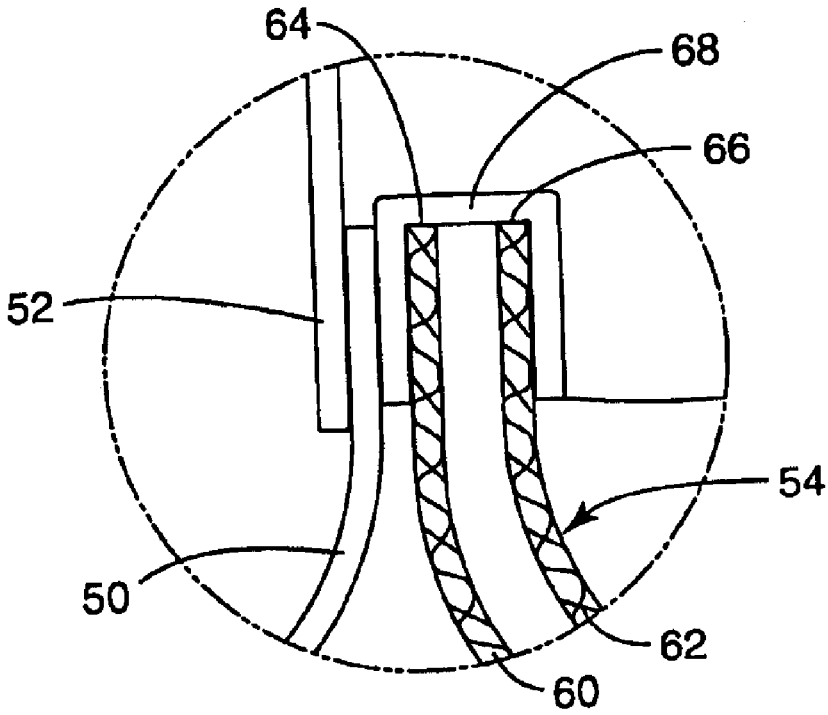
FIG. 4 shows a magnified cross-sectional view of a portion of FIG. 3.

FIG. 4 shows a partial cross-sectional view of a portion of FIG. 3 taken along line 4–4' in FIG. 3. As shown, porous seal 54 is formed from two folded layers 60, 62 of knitted fabric whose ends 64, 66 are wrapped with a fabric tape or other suitable cover 68 and fastened (e.g., by stitching) to hood portion 52 and body portion 50.

Porous seal 54 does not have to be in the form of a porous fabric collar. Seal 54 can be replaced by a variety of other materials or devices that will provide a suitable partial flow restriction between hood portion 52 and body portion 50, such as a non-porous collar equipped with a suitable drawstring, a generally non-porous collar that includes a perforated plastic or leather sheet portion, a suitable valve or valves, a labyrinth seal, a hose or other orifice having a suitably small diameter or other suitable flow-restricting device.

Protective suit 20 can be constructed from readily available materials and parts. Representative suits include those available from Respirex of Redhill Surrey, England and from Kappler, Inc. of Guntersville, Ala. Representative barrier materials include a high performance chemical barrier available from E. I DuPont de Nemours and Co. of Wilmington, Del. and sold under the trade designation TYCHEM™ TK, a high performance chemical barrier available from Kappler, Inc. and sold under the trade designation ZYTRON™ and a medium to low chemical barrier available from DuPont and sold under the trade designation TYVEK™ F. Other barriers are contemplated and may be selected based on the intended application. The suit may also include a combination of barriers such as a body portion constructed from a heavier high performance chemical barrier and a hood portion constructed from a lighter medium to low performance chemical barrier. The barrier is typically over 90 percent fluid tight, depending on the application. In one embodiment, the barrier is suitable for liquid applications, which typically means a mist or jet of liquid can be incident on the barrier and the barrier will be impervious to the liquid. For example, a barrier that is impervious to liquid may be only 95 percent gas tight. In another embodiment, the barrier may be constructed from a material that is impervious to gas. Often, any seams in the material are taped or welded to also be fluid tight. Accordingly, the barrier is generally impervious to the contaminant of a particular application, and does not necessarily hermetically seal the inner environment from the outer environment.

Blower 34, if employed, can be isolated within suit 20, thus simplifying construction of the blower, avoiding the need for decontamination after use, and reducing maintenance costs. Isolating the blower can also prolong the blower's life, simplify cleaning, and permit the user to enter a decontamination shower or undergo other decontamination treatments without harm to the blower. Blower 34 can be driven by an internal or external power source such as a battery or pneumatic fluid supply. If the power source is located externally, barrier 22 may need to be fitted with suitably fluid-tight pass-throughs to provide power efficiently to the blower. A suitable blower 34 is available from 3M Company and is sold in the United Kingdom under the trade designation JUPITER™. This blower runs on an internal battery (not shown in FIG. 2) such as a four hour battery, an eight hour battery, an intrinsically safe battery, or a lithium battery. A lithium battery is particularly suited for applications where the suit may sit on a shelf for several years before it is needed. The lithium battery is currently not rechargeable, whereas the first three batteries are rechargeable. Another suitable blower is available from Safety Equipment Australia and sold under the trade designation SE400AT™.

Filter 36, if employed, can be chosen based on the particular application, contaminant and chosen blower. One suitable filter is available from 3M Company and sold as a class ABEK P3 filter for use with the above-mentioned JUPITER blower. Another suitable filter is available from Safety Equipment Australia and sold as a class ABEK3P4 filter for use with the above-mentioned SE400AT blower. The filter may also be one suitable for use in outer environments in which the contaminants include chemical or biological weapons.

When employed, filter 36 and blower 34 preferably are connected via a sealed port that provides a generally fluid tight connection to the barrier and blower during filter replacement, as is more fully described in copending application Ser. No. 10/263,894 entitled PERSONAL CONTAINMENT SYSTEM WITH SEALED PASSTHROUGH, filed even date herewith, the entire disclosure of which is incorporated herein by reference. Such a sealed port permits replacement of the filter under hazardous conditions, without requiring the user to exit a contaminated or otherwise hazardous environment. Leakage of contaminants into the system is minimized, and limited to materials that might enter the blower inlet. The blower inlet remains accessible during filter replacement despite sudden movement by the user or other disturbance of the suit while the filter is disconnected, thereby speeding and simplifying the filter replacement process.

The invention is especially suited for use in situations where a contaminated or otherwise hazardous environment is known to include oxygen, but whose hazards are otherwise generally unknown. The invention can be used in environments where electric sparks or the like can provide a hazard. The suits of the invention can be much less expensive to manufacture or maintain than protective suits that include a face piece.

Although the personal protective suit and its components have been described with reference to examples, or embodiments, it is to be understood that changes may be made in form and detail without departing from the spirit and scope of the invention.

We claim:

1. A personal protective suit for a wearer, comprising:

a generally fluid-tight barrier comprising a hood portion located generally above the wearer's neck and at least partially enveloping the wearer's nose and mouth, and a body portion located generally below the wearer's neck and at least partially enveloping the wearer's torso;

an air delivery system that can deliver air to the hood portion;

a vent that can permit gasses to escape from the body portion;

a partial flow restriction between the hood portion and body portion that can permit gasses to pass from the hood portion to the body portion while reducing carbon dioxide levels measured in front of the wearer's mouth.

2. The personal protective suit of claim 1 wherein the suit completely envelops the wearer.

3. The personal protective suit of claim 1 wherein the suit does not include a face piece.

4. The personal protective suit of claim 1 wherein the partial flow restriction comprises a porous neck seal.

5. The personal protective suit of claim 4 wherein the porous neck seal comprises knitted fabric.

6. The personal protective suit of claim 4 wherein the porous neck seal comprises non-woven material.

7. The personal protective suit of claim 1 wherein the measured carbon dioxide level is below about 0.5% when measured in accordance with European Standard EN 12941:1998.

8. The personal protective suit of claim 1 wherein the air delivery system provides filtered air to a blower and thence to the hood portion.

9. The personal protective suit of claim 8 wherein the blower is substantially disposed inside the suit.

10. The personal protective suit of claim 8 wherein the air delivery system comprises a filter substantially disposed outside the suit.

* * * * *